US005926090A

United States Patent [19]

Taylor et al.

[11] Patent Number: 5,926,090

[45] **Date of Patent: *Jul. 20, 1999**

[54] LOST ARTICLE DETECTOR UNIT WITH ADAPTIVE ACTUATION SIGNAL RECOGNITION AND VISUAL AND/OR AUDIBLE LOCATING SIGNAL

[75] Inventors: Charles Edwin Taylor, Sebastapol; Shek Fai Lau, Foster City, both of Calif.

[73] Assignee: Sharper Image Corporation, San Francisco, Calif.

[ * ] Notice: This patent is subject to a terminal disclaimer.

[21] Appl. No.: 08/920,224

[22] Filed: Aug. 25, 1997

Related U.S. Application Data

[63] Continuation-in-part of application No. 08/703,023, Aug. 26, 1996, Pat. No. 5,677,675.

[51] Int. Cl.[6] ..... G08B 13/14

[52] U.S. Cl. ..... 340/568.1; 340/573.1; 340/571; 340/825.36; 340/825.49; 340/825.72; 367/198; 367/199

[58] Field of Search ..... 340/568, 573, 340/571, 825.36, 825.49, 825.72, 573.1, 568.1; 367/198, 199

[56] References Cited

U.S. PATENT DOCUMENTS

| | | | |
|---|---|---|---|
| 3,949,353 | 4/1976 | Waters et al. | 367/36 |
| 4,507,653 | 3/1985 | Bayer | 340/539 |
| 5,315,704 | 5/1994 | Shinta et al. | 704/232 |
| 5,677,675 | 10/1997 | Taylor et al. | 340/568 |
| 5,699,809 | 12/1997 | Combs et al. | 600/558 |

*Primary Examiner*—Benjamin C. Lee
*Attorney, Agent, or Firm*—Flehr Hohbach Test Albritton & Herbert LLP

[57] ABSTRACT

A lost article detector unit includes a microprocessor programmed to execute adaptive actuation signal recognition that discerns desired activation sounds from noise. Preferably the desired activation sounds include a sequence of four adjacent spaced-apart hand claps made by the same user. A transducer provides amplified sound signals to the microprocessor, which then analyzes and stores pattern information associated with the first clap-pair. Signals from a second clap-pair are then analyzed and compared with stored pattern information from the first clap-pair, using the algorithm. The adaptive use of such pattern information permits imposing timing tolerances that are sufficiently tight to reduce false triggering, without requiring the user to memorize a rigid sequence pattern of clapping. Upon microprocessor-recognition of desired activation sounds, the microprocessor causes the transducer to provide a locating signal that may be visual and/or audible. Audible locating signals may include synthesized human speech (in more than one language and/or voice), songs, music, among other signals. The activation signal permits a user to locate the detector unit and small objects attached thereto.

38 Claims, 9 Drawing Sheets

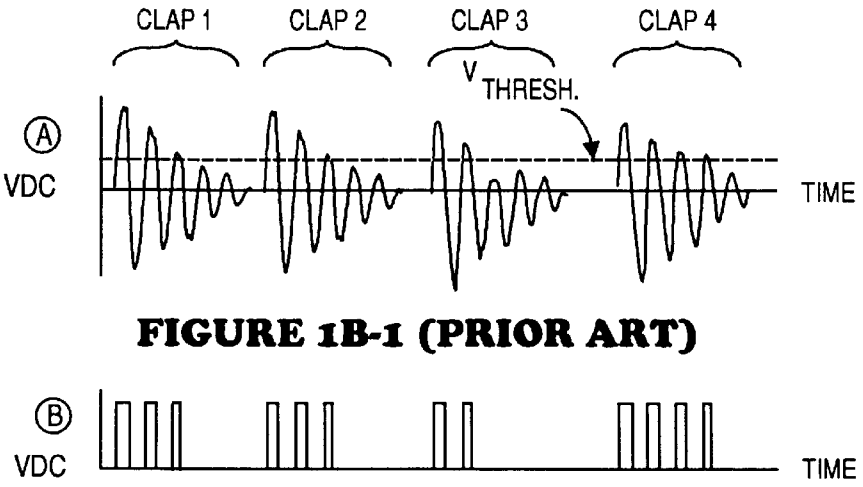
FIGURE 1B-1 (PRIOR ART)
FIGURE 1B-2 (PRIOR ART)
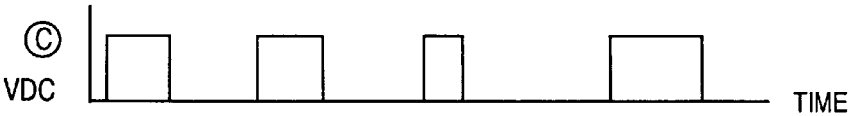
FIGURE 1B-3 (PRIOR ART)
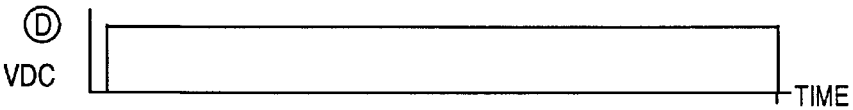
FIGURE 1B-4 (PRIOR ART)
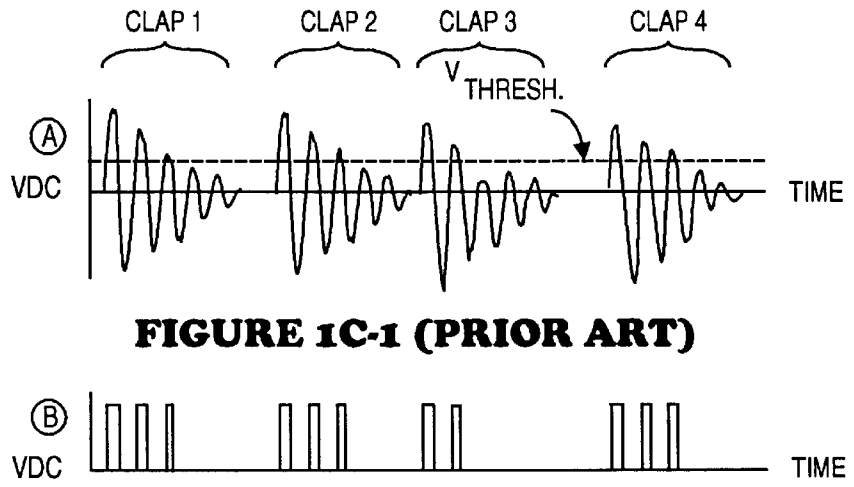
FIGURE 1C-1 (PRIOR ART)
FIGURE 1C-2 (PRIOR ART)
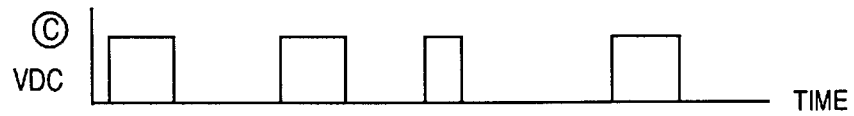
FIGURE 1C-3 (PRIOR ART)
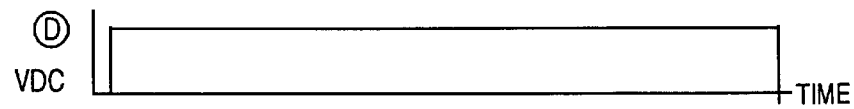
FIGURE 1C-4 (PRIOR ART)

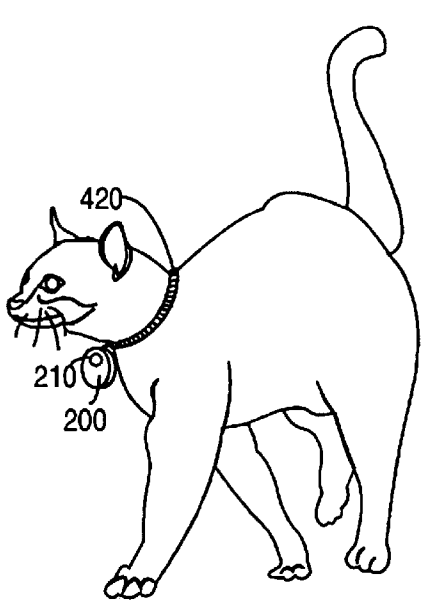
FIGURE 5A
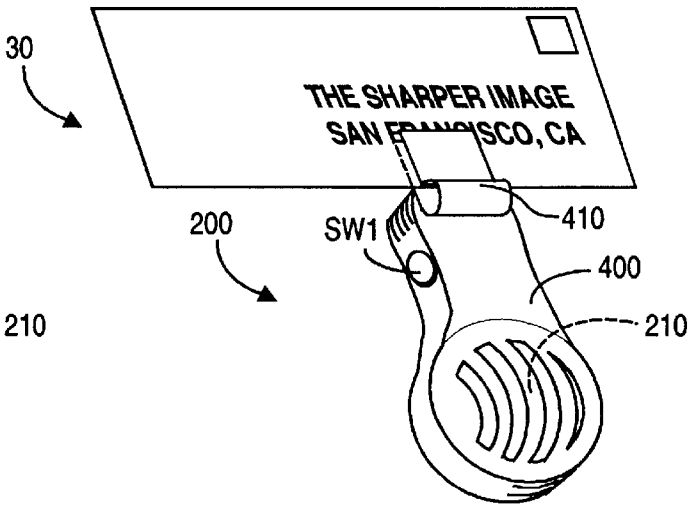
FIGURE 5B
FIGURE 5C

LOST ARTICLE DETECTOR UNIT WITH ADAPTIVE ACTUATION SIGNAL RECOGNITION AND VISUAL AND/OR AUDIBLE LOCATING SIGNAL

RELATIONSHIP TO PREVIOUSLY FILED APPLICATION

This application is a continuation-in-part of U.S. patent application Ser. No. 08/703,023 filed Aug. 26, 1996, now U.S. Pat. No. 5,677,675.

FIELD OF THE INVENTION

This invention relates to devices that are attached to misplaceable objects and emit a signal locating the objects upon receipt of an audible actuation signal, and more specifically to improved recognition of such actuation signals in such devices.

BACKGROUND OF THE INVENTION

Small objects such as keys, eyeglasses, remote control units for TVs and VCRs are readily misplaced. It is known in the art to attach to such objects a detector unit that can emit an audible beeping signal when a definitive pattern of human-generated audible whistles, hand claps, or the like is heard. The recognizable patterns of human-generated sounds, hand claps for example, are termed desired actuation sounds.

Typically the detector unit includes a microphone, waveform shapers, electronic timers, a beeping sound generator, and a loudspeaker. The microphone is responsive to audible sound, which can include the desired actuation sounds as well as ambient noise, and commonly a piezoelectric transducer functions as both the microphone and the loudspeaker. The waveform shapers attempt to discriminate between waveforms resulting from desired actuation sounds, and waveforms from all other sounds. The waveform shaper output signals are coupled to electronic timers in an attempt to further discriminate between desired actuation sounds and all other microphone detected sounds. Ideally, the detector unit provides a beeping signal into the loudspeaker only when the desired searcher-generated actuation sounds are detected. The loudspeaker beeping is a locating signal that enables a user to locate the objects attached to the detector unit from the beeping sound.

Unfortunately, prior art detector units tend to not respond at all, or to false trigger too frequently. By false trigger it is meant that the units may output the beeping sound in response to random noise, human conversation, dogs barking, etc., rather than only in response to desired human-generated actuation sounds. One approach to minimizing false triggering is to design the detector unit to recognize only a specific pattern of desired actuation sounds, for example, a series of hand claps that must occur in a rather rigid timing pattern.

U.S. Pat. No. 4,507,653 to Bayer (1985), a simplified version of which is shown in FIG. 1A, typifies such detector units. Referring to FIG. 1A, a Bayer-type detector unit 10 may be coupled by a cord, a key ring or the like 20 to one or more objects 30, e.g., keys. Ideally, unit 10 responds to audible activation sounds 40 generated by a human user (not shown), and should not respond to noise or other sounds. When the desired activation sounds are present, unit 10 should output audible sound 50, which alerts the user to the location of the objects 30 affixed to the unit. Otherwise, unit 10 should not output any sounds.

As disclosed in the Bayer patent, unit 10 includes a microphone-type device 60 that responds to ambient audible sound (both desired activation sounds and any other sounds that are present). These transducer-received analog sounds are shown as waveforms A in FIGS. 1A, 1B-1 and 1C-1. In FIGS. 1B-1 and 1C-1, waveforms representing four hand claps (or similar sounds) are shown. By way of example, in FIG. 1B-1, the first two hand claps occur closer together in time than do the first two hand claps in FIG. 1C-1. These waveform A signals are amplified by an amplifier 70, whose output is coupled to a Schmitt trigger unit 80. The Schmitt trigger unit compares the magnitude of the incoming waveforms A against a threshold voltage level, $V_{THRESHOLD}$. When waveform A exceeds $V_{THRESHOLD}$, the Schmitt trigger outputs a digital pulse, shown as waveform B in FIGS. 1A, 1B-2, 1C-2.

The Schmitt trigger digital pulses are then input to an envelope shaper 90 that provides a rectifying function. If the Schmitt trigger digital pulses (waveform B) are sufficiently close together, e.g., <125 ms or so, the envelope shaper output will be a single, longer-duration, "binary pulse". These binary pulses are shown as waveform C in FIGS. 1A, 1B-3, and 1C-3. Collectively, the Schmitt trigger and envelope shaping are intended to help unit 10 discriminate between desired activation sounds and all other sounds.

The start of a binary pulse is used in conjunction with digital timer-counter units, collectively 100, and latch units, collectively 110, to generate various predetermined time periods. Bayer relies upon a first predetermined time period, which is shown as waveform D in FIG. 1A, 1B-4 and 1C-4, to determine whether desired activation signals have been heard by microphone 60. Waveform D will always be a fixed first predetermined time period $T_{p-1}$, for example, 4 seconds. Per the '653 patent, if four binary pulses occur within that fixed first predetermined time, unit 10 will cause an audio generator 120 to output beep-like signals to a loudspeaker 130. (In practice, Bayer's loudspeaker 130 and microphone 60 are a single piezo-electric transducer.)

Even though the user-generated activation sounds must adhere to a predetermined pattern, Bayer-type units still tend to false trigger by also beeping in response to noise, conversation, etc. For example, although the time separation of various waveforms A in FIGS. 1B-1 and 1C-1 differ, each waveform set results in four binary pulses occurring within the time period $T_{p-1}$, and beeping results in both cases. Thus, Bayer-type units do not try to discriminate against noise sounds by examining and comparing patterns associated with pairs of hand claps. Instead, discrimination between noise and user-activation sounds is based upon rather static timing relationships designed and built into the unit.

Further, Bayer-type units can be difficult to use because the properly timed sequence of activation sounds, e.g., claps, must first be learned by a user. Unless the user learns how to clap in a proper sequence that matches the static signal recognition inherent in Bayer's detector unit, the unit will not properly activate and beep. Indeed, Bayer provides a built-in visual indicator to assist a user in learning the properly timed hand clapping sequence.

Even if prior art detector units can be made to operate properly, it will be appreciated that generated beep-like audio tones may not readily allow a user to locate the unit. Users generally have more experience in successfully locating the origin of an audible locating signal that is a human voice, rather than a beep-like tone. Further, in generating an audible locating signal, prior art devices ignore users who may be hearing impaired, or who could nonetheless benefit from a locating signal that was visual and/or audible.

Thus, there is a need for a detector unit having improved response to desired user-generated activation sounds, while not responding to other sounds. Such unit should not unduly comprise between timing constraints that improve immunity to false triggering, and ease of generating desired activation sounds. In discerning between incoming sounds to decide whether to output a locating signal, preferably such unit should adapt dynamically to a user's pattern of activation sounds, rather than force the user to learn a static sequence of such sounds. Finally, the unit should be usable by any user, and not be dedicated to a single user. Preferably such unit should provide capability to generate a locating signal that is visual and/or audible, and if audible, a locating signal that can include a human voice. Further, such unit should provide good signal recognition, even in the presence of high magnitude ambient noise.

The present invention provides such a detector unit, and a method of adaptively recognizing desired actuation sounds, such as hand claps.

SUMMARY OF THE PRESENT INVENTION

In a first aspect, the present invention provides a lost article detector unit with an adaptive actuation signal recognition capability. Within the detector unit, amplified transducer-detected audio sound is input directly to a microprocessor. The microprocessor is programmed as a signal processor, and executes an adaptive algorithm that discerns desired activation sounds from noise. When such sounds are recognized, the microprocessor causes the transducer to provide a locating signal, produced by a locating signal generator, that may be visual and/or audible. Preferably the detector unit includes a light emitting diode ("LED") that may be activated to provide a visual and preferably blinking locating signal that is especially useful in a dark environment and to hearing impaired users. Further, the detector unit optionally includes a sound module that can output a locating signal that synthesizes a human voice. The synthesized locating signal may be a vocal message stating "I am over here", which message may be more useful to a user than a beeplike tone when attempting to locate the source of the sound. If desired, the microprocessor may be programmed to recognize more than one pattern of desired activation sounds, with the result that the sound module can output a different vocal message locating signal in response to each different desired activation sound.

Preferably audio gain is adaptively selected by the microprocessor as a function of environmental background noise, such that lower audio gain is used in the detected presence of high magnitude noise. In a preferred embodiment, transducer signals are coupled to the input of two amplifiers: a high gain amplifier and a lower gain amplifier. Each amplifier output triggers a one-shot, and the one-shot outputs are coupled to the microprocessor, which counts the relative frequency of noise-generated one-shot pulses within a given time for each amplifier gain channel. If the high-gain channel outputs too many noisegenerated pulses, then the microprocessor will use the lower-gain channel until ambient noise is reduced. The use of adaptive gain selection preliminarily to actual clap signal processing and discrimination further promotes device performance.

Preferably the activation sounds are a sequence of four adjacent spaced-apart hand claps, all made by the same user. Applicants have discovered that when the same user generates a first clap-pair and subsequent clap-pair(s), pattern information contained in the first clap-pair can be used to recognize subsequent clap-pair(s). This permits imposing a reasonably tight timing tolerance on subsequent clap-pairs (to reduce false triggering), without requiring the user to learn how to clap in a rigid sequence pattern. Different users may create different pattern information, but there consistency between the first clap-pair and subsequent clap-pairs will be present.

Within the microprocessor, a clock, counters, and memory calculate and store time-duration of the various sounds and inter-sound pauses. A sequence of four sounds is represented as count values P0, C1, P1, C2, P2, C3, P3, C4 and P4, where C values represent sound duration and P values are inter-sound pause durations.

Preliminarily, the microprocessor determines whether C1, P1, C2, P2, P3, and P4 each fall within "go/no-go" test limits. If not, noise is presumed and the counters and memory are reset. But if preliminary test limits are met, the microprocessor executes an algorithm that uses pattern information in the first clap pair to help recognize subsequent clap pair(s). If desired, the preliminary tests may occur after executing the algorithm.

The algorithm preferably requires that each of the following relationships be met:

(a) $|C3-C1|/C1<Ta\%$ (b) $|P3-P1|/P1<Tb\%$ (c) $|C4-C2|/C2<Tc\%$ (d) $|R2-R1|/R1<Td\%$ where R1=C1+P1, R2=C3+P3, and Ta, Tb, Tc, Td are factory selectable tolerance options, e.g., 10%.

Acceptable results can sometimes be obtained by activating the beeping locating signal upon satisfaction of only three of the above relationships. However, performance reliability is improved by using relationships (a), (b), (c), (d), and at least the P2>P1, and P2>P3 preliminary relationships. Reliability is highest when using all of the preliminary test relationships, and all four of relationships (a), (b), (c) and (d). The order in which the (a), (b), (c), (d) and preliminary relationships is tested is not important.

If the desired number of relationships is satisfied, the detector unit provides an audio signal to the transducer. The transducer outputs an audible beeping locating signal that enables a user to locate the unit and objects attached thereto. If any condition is not met, the counters and memory are reset and no beeping occurs for the current sequence of sounds.

In a second aspect, the LED within the detector unit provides a flashlight function. In a third aspect, the clock and timers within the microprocessor may be user-activated to provide a count-down interval timer, in which the unit beeps after multiples of time increments, e.g., 15 minutes, 30 minutes, etc.

Other features and advantages of the invention will appear from the following description in which the preferred embodiments have been set forth in detail, in conjunction with the accompanying drawings.

BRIEF DESCRIPTION OF THE DRAWINGS

FIGS. 1B-1, 1B-2, 1B-3 and 1B-4 depict various waveforms in the detector unit of FIG. 1A for a first sequence of four sounds;

FIGS. 1C-1, 1C-2, 1C-3 and 1C-4 depict various waveforms in the detector unit of FIG. 1A for a second sequence of four sounds;

FIG. 2 is a block diagram of a lost article detector unit with adaptive actuation signal recognition, according to the present invention;

FIG. 3 depicts the analog amplifier output waveform corresponding to a sequence of four sounds, and defines time intervals used in the present invention;

FIG. 4 is a flow diagram showing a preferred implementation of an adaptive signal processing algorithm, according to the present invention;

FIG. 5A depicts a preferred embodiment of the present invention including flashlight and interval timer functions;

FIG. 5B depicts an alternative embodiment of the present invention, useful in locating objects clipped to the detector unit;

FIG. 5C depicts the present invention used with an animal collar to locate a pet;

DETAILED DESCRIPTION OF THE PREFERRED EMBODIMENT

Figure 1A:
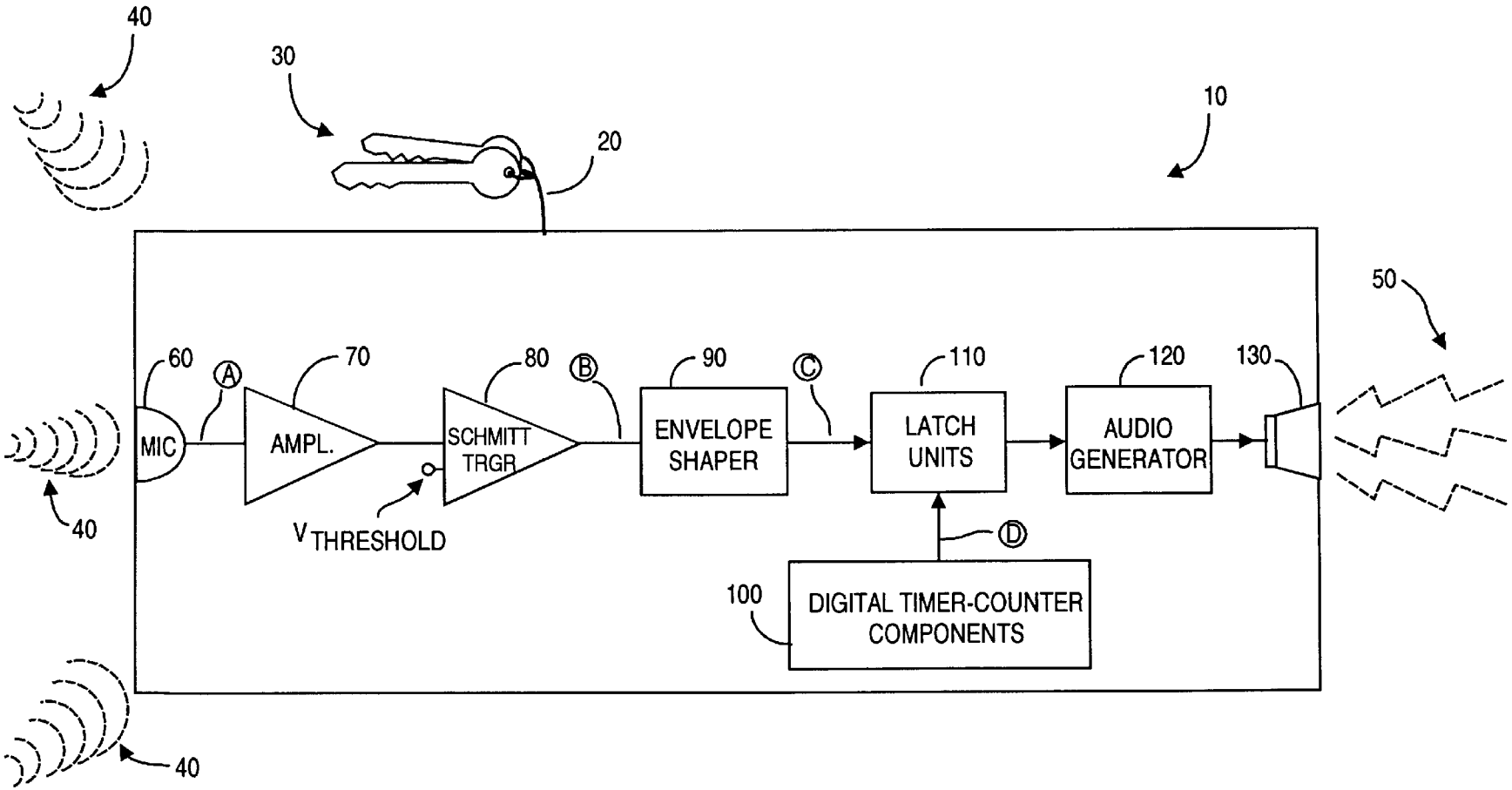
FIGURE 1A (PRIOR ART)
FIG. 1A depicts a lost article detector unit with static actuation signal recognition, according to the prior art.
Figure 2:
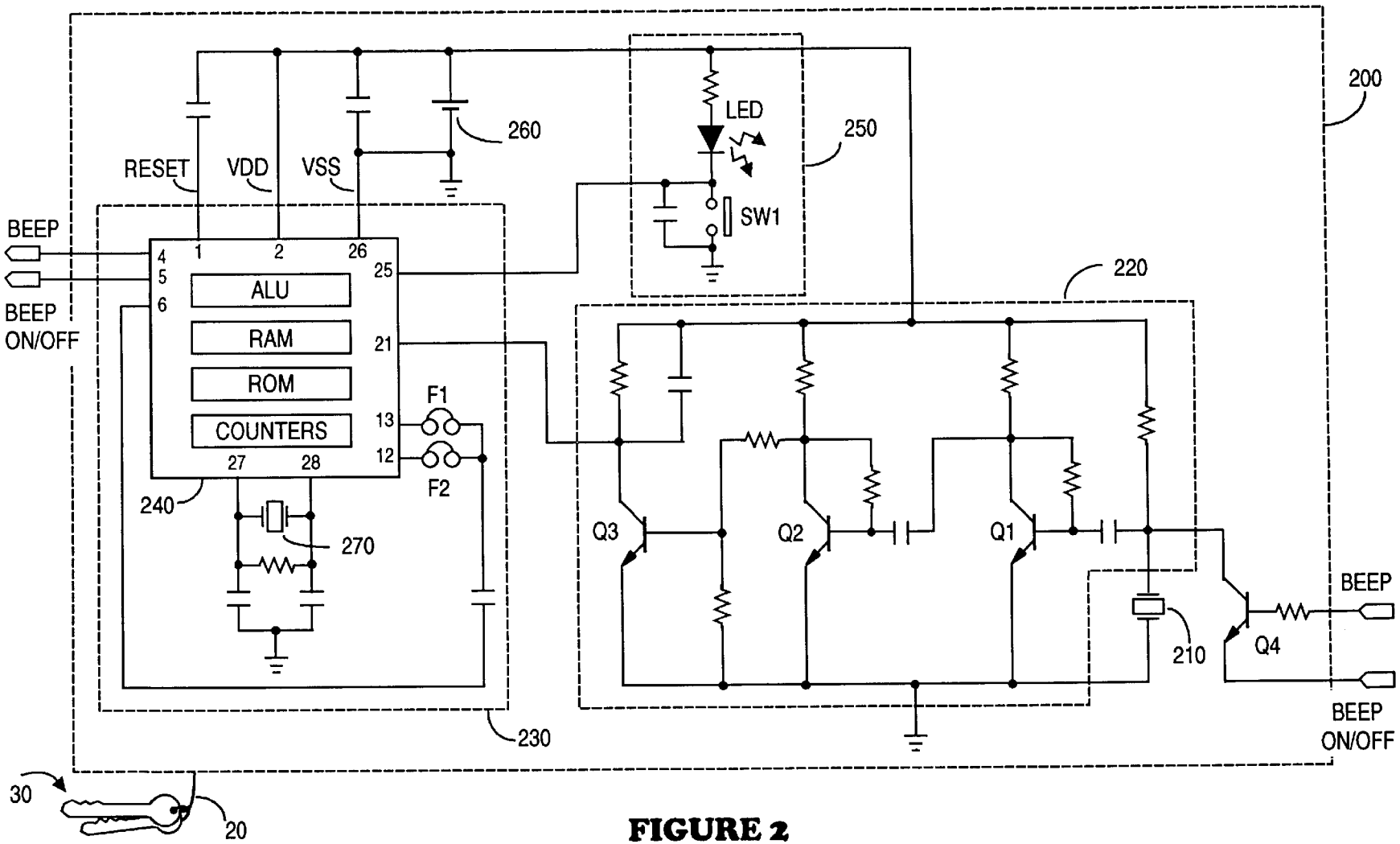

FIG. 2 depicts a detector unit 200, according to the present invention. Unit 200 includes a preferably piezoelectric transducer 210 that detects incoming sound and also beeps audibly when desired incoming activation sounds have been heard and recognized. Unit 200 further comprises an audio amplifier 220, a signal processor 230 based upon a microprocessor 240, and optionally includes a flashlight and event timer control switch unit 250. Unit 200 preferably operates from a single battery 260, for example, a CR2032 3 VDC lithium disc-shaped battery.

In the preferred embodiment, amplifier 220 is fabricated with discrete bipolar transistors Q1, Q2, Q3, although other amplifier embodiments may instead be used. Amplifier 220 receives audio signals detected by transducer 210, and amplifies such signals to perhaps 2 V peak-peak amplitude. The thus-amplified analog audio signals are then coupled directly to an input port of microprocessor 240. Of course if unit 200 employs a transducer 210 that outputs a sufficiently strong signal, amplifier 220 may be dispensed with, or can be replaced with a simpler configuration providing less gain.

When unit 200 is not outputting a beep locating signal from transducer 210, transistor Q4 is biased off by two signals ("BEEP" and "BEEP ON/OFF") available from output ports on microprocessor 240. In this mode, transistors Q1, Q2, Q3 amplify whatever audible signals might be heard by transducer 210. However, when unit 200 has heard and recognized desired user activation sounds, the microprocessor output BEEP and BEEP ON/OFF signals cause transistor Q4 to oscillate on and off at an audio frequency causing transducer 210 to beep loudly for a desired time period. It is this beeping output locating signal that alerts a nearby user to the whereabouts of unit 200 and any objects 30 attached thereto.

In the preferred embodiment, microprocessor 240 is a Seiko S-1343AF CMOS IC (complementary metal on silicon integrated circuit) capable of operation with battery voltages as low as about ±1.5 VDC. The S-1343AF is a 4-bit minicomputer that includes a programmable timer, a so-called watch dog timer, arithmetic and logic unit ("ALU"), non-persistent random access memory ("RAM"), persistent read only memory ("ROM"), various counters, among other functions. In the preferred embodiment, a 455 KHz resonator 270 establishes the basic microprocessor clock frequency. Factory blowable fuses F1, F2 permit production tuning of timing precision tolerances, if desired or necessary. The pin numbers called out in FIG. 2 for microprocessor 240 relate to this Seiko IC, although other devices could instead be used.

Signal processing within unit 200 will now be described. According to the present invention, ROM within microprocessor 240 is programmed to implement an algorithm that adaptively recognizes desired user-generated activation sounds. (This programming is permanently "burned-in" to the microprocessor during fabrication, using techniques well known to those skilled in the art.) The algorithm is adaptive in that in a sequence of sounds, rhythm and timing patterns present in the first sound-pair are calculated and stored. Since it is presumed that subsequent sounds in the sequence were also generated by the same user, the stored information can meaningfully be compared to information present in the subsequent sounds. The algorithm then determines from such comparison whether common pattern characteristics are exhibited between the first sound-pair and subsequent sound-pair(s), including rhythm, timing, and pacing information. If such common characteristics are found, the locating beeping signal is output.

Figure 3:
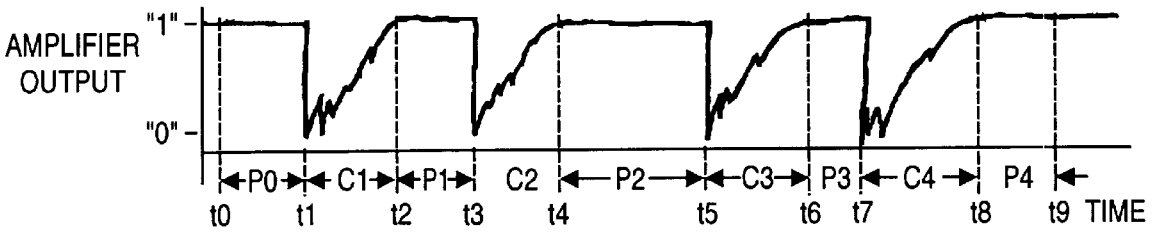

It is useful at this juncture to examine FIG. 3, an oscilloscope waveform of the analog signal output from amplifier 220 to microprocessor 240. In FIG. 3, a sequence of four sounds is shown, for example, a first hand clap-pair and a second hand clap-pair. The pause period preceding the first sound is defined as P0. The first sound has duration defined as C1, and is separated by an inter-sound pause defined as P1 from a second sound having a duration defined as C2. Collectively, C1-P1-C2 may be said to define a first sound pair. Spaced-apart from the first sound pair by a pause defined as P2 is a second sound pair. The second sound pair comprises a third sound of duration C3, an inter-sound pause P3, and a fourth sound of duration C4. After this second sound pair there occurs a pause defined as P4.

The various sound and pause durations are determined by the microprocessor. As noted, resonator 270 establishes a microprocessor clock signal frequency. In a preferred embodiment, pulses from the clock signal are counted by counters within the microprocessor for however long as each inter-pulse period, e.g., P0 lasts, for however long as each sound interval, e.g., C1 lasts, and so on. Within microprocessor 240, digital counter values represent a measure of the various time intervals P0, C1, P1, C2, P2, C3, P3, C4, P4. The various counts for P0, C1, P1, C2, P2, C3, P3, C4, P4 are then preferably non-persistently stored in RAM within the microprocessor, as shown in FIG. 2.

Figure 4:
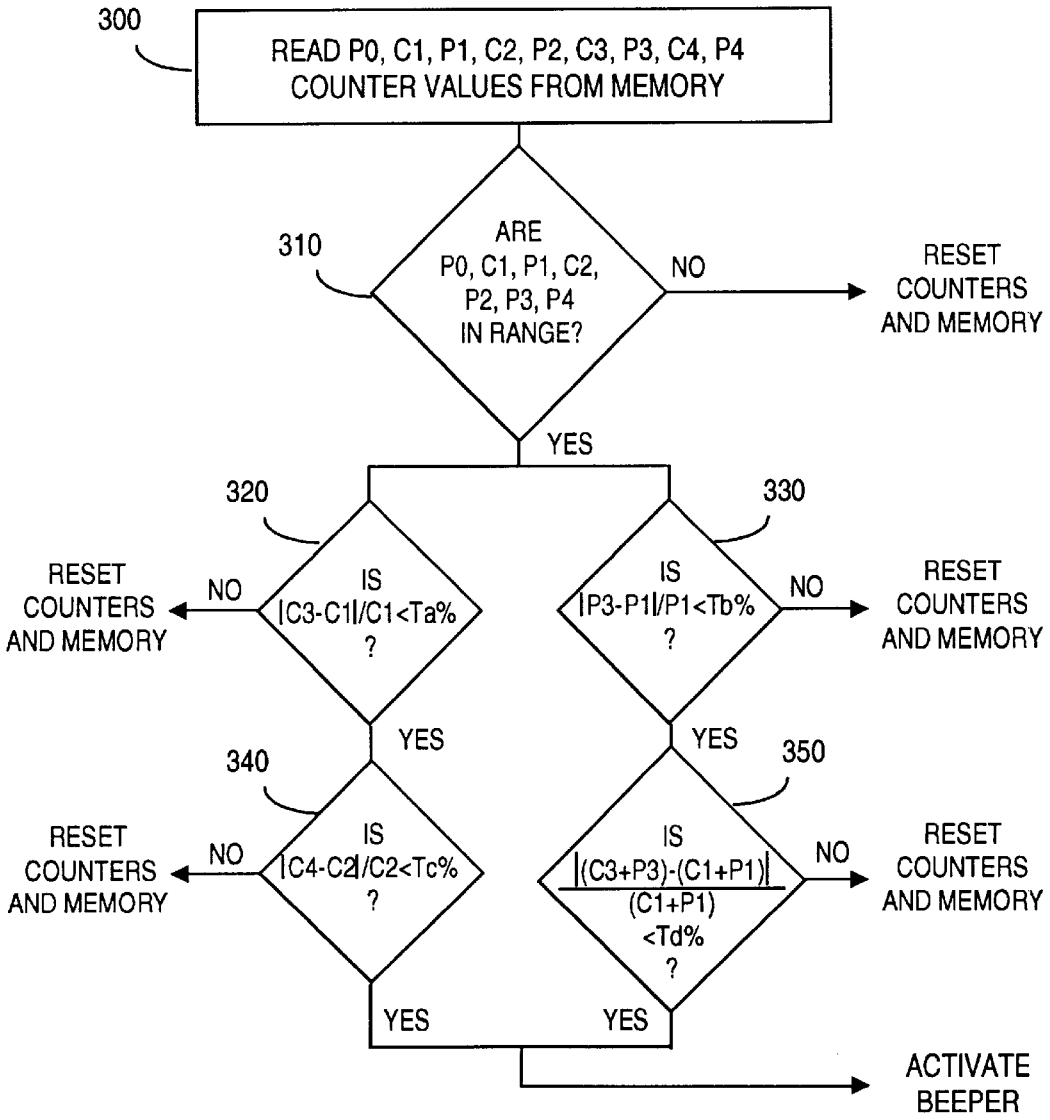

FIG. 4 depicts various steps executed by the microprocessor in carrying out applicants algorithm. At step 300, the count values for P0, C1, P1, C2, P2, P3, and P4 are read out of the relevant memories, and at step 310 the microprocessor preliminarily determines whether each of these parameters falls within "go/no-go" test limits. If not, the counters and memories preferably are reset, and the next incoming sounds will be examined. These "no/no-go" tests are termed "preliminary" in that they do not involve testing pattern information in clap-pairs against each other. If desired, the order of the individual preliminary tests is not important, and indeed some or all of the preliminary tests may occur during or after execution of the main algorithm.

Consider a preferred embodiment in which a sequence of two clap-pairs represents the desired activation sound. In this embodiment, preferably $P0 \geqq t_{P0min}$, where $t_{P0min}$=1,000 ms. If P0<1,000 ms, then the immediately following sound cannot necessary be assumed to be the first sound in a sequence, and all counters and memory contents should be reset. Each of C1 and C2 should satisfy $t_{Cmin} \leqq C1$ or $C2 \leqq t_{Cmax}$, where preferably $t_{Cmin}$=50 ms and $t_{Cmax}$=125 ms. The first inter-sound pause P1 should satisfy $t_{P1min} \leqq P1 \leqq t_{P1max}$, where preferably $t_{P1min}$=125 ms and $t_{P1max}$=250 ms. Inter-sound pause P1 should also satisfy P1<P2. The pause between sound pairs P2 should satisfy $t_{P2min} \leqq P2 \leqq t_{P2max}$, where preferably $t_{P2min}$=500 ms and $t_{P2max}$=2,000 ms. Inter-sound pause P3 should satisfy the relationship P3<P2. The fourth pause P4 should satisfy $P4 \geqq t_{4min}$ where preferably $t_{4min}$=500 ms. If any of these preliminary relationships is not satisfied, the relevant counters and memories within microprocessor 240 preferably are reset, and the next incoming sequence of sounds is examined. Preferably the values of $t_{P0min}$, $t_{Cmin}$, $t_{Cmax}$, $t_{P1min}$, $t_{P1max}$, $t_{P2min}$, $t_{P2max}$, and $t_{4min}$ are persistently stored within memory in the microprocessor, e.g., the preferred values are burned into ROM. Although the "go/no-go" values set forth above have been found to work well in practice for a hand clap sequence, other values may instead be used for some or all of the parameters. Of course if the activation sound is other than a sequence of hand claps, different parameters will no doubt be defined.

Assuming that each of the preliminary "go/no-go" tests are met, microprocessor 240 processes the algorithm preferably burnt into the microprocessor ROM. Specifically, the preferred embodiment requires that at least three and preferably all four of the following relationships (a), (b), (c) and (d) be met before microprocessor 240 causes transducer 210 to beep an audible locating signal:

(a) $|C3-C1|/C1<Ta\%$ (b) $|P3-P1|/P1<Tb\%$ (c) $|C4-C2|/C2<Tc\%$ (d) $|R2-R1|/R1<Td\%$ where Ta, Tb, Tc, Td are factory selectable option values such as 10%, 20%, etc. and preferably are persistently stored in ROM within the microprocessor. In the above relationships, R1=C1+P1, and R2=C3+P3.

The number of (a), (b), (c), (d) relationships required to be satisfied preferably is programmed into the microprocessor. However, one could program a microprocessor to dynamically execute the algorithm with options. For example, if conditions (a) through (d) and preliminary conditions P2>P1, and P2>P3 are each met, then test no further, and activate the beeping locating signal. However, if only three of conditions (a) through (d) are met, then insist upon passage of all preliminary test conditions. Of course, other programming options may instead be attempted.

Calculation of relationships (a), (b), (c), (d) may occur in any order. Thus, while for ease of illustration FIG. 4 shows steps 320 and 330 determining relationships (a) and (b) simultaneously, after which steps 340 and 350 determine relationships (c) and (d) simultaneously, such need not be the case. For example, all four relationships could be determined simultaneously, all four relationships could be determined sequentially in any order, or some of the relationships may be determined simultaneously and the remaining relationships then determined sequentially, etc. As noted, the preferred embodiment requires that all preliminary "go/no-go" tests be passed, and that all relationships (a), (b), (c), and (d) be met before unit 200 is allowed to beep audibly in recognition of sounds detected by transducer 210.

Relationship (a) broadly uses the time duration of the first sound (or first clap) as a basis for testing the time duration of the third sound (or third clap). Relationship (b) broadly uses the inter-sound pause between the first and second sounds (e.g., between the claps in a first clap-pair) as a basis for testing the inter-sound pause between the third and fourth sounds (e.g., between the claps in the second clap-pair). Relationship (c) broadly uses the time duration of the second sound (or second clap) as a basis for testing the time duration of the fourth sound (or fourth clap). Relationship (d) broadly uses pacing information associated with the first two sounds (e.g., the first clap-pair) as a basis for testing pacing information associated with the third and fourth sounds (e.g., the second clap-pair).

With respect to having unit 200 respond to a desired actuation sound comprising spaced-apart clap-pairs, relationships (a), (b), (c), and (d) take into account that the same person who generates the first clap-pair will also generate the second clap-pair. Thus, by calculating and storing pattern information including timing and pacing for the first clap-pair, microprocessor 240 can more intelligently determine whether the following two sounds are indeed a second clap-pair. If the same person who generated the first two sounds (preferably the first clap-pair) also generated the next two sounds (preferably the second clap-pair), then there will be some consistency in the nature of the patterns associated with the two sets of sounds. Experiments conducted by applicants using device 200 and various users have resulted in relationships (a), (b), (c), and (d).

As noted, the most reliable performance of the present invention is attained by not activating the beeping (or other) locating signal unless all four relationships are met. Satisfactory results can be attained however using less than all four relationships, although incidents of false triggering will increase.

The use of a dynamic algorithm to determine whether what has been heard by transducer 210 is the desired activation pattern permits imposing fairly stringent internal timing requirements on the first clap-pair. The calculated and stored pattern information from the first clap-pair permits good rejection of false triggering, yet does not require a user to learn rigid patterns of clapping to reliably produce beeping on a subsequent clap-pair.

In contrast to prior art sound detector units, the present invention dynamically adapts to the user, rather than compelling the user to adapt to a rigid pattern of recognition built into the detector.

The preferred embodiment has been described with respect to a desired activation pattern comprising two sets of sounds, each comprising a clap-pair. However, it will be appreciated that the invention could be extended to M-sets of sounds, each sound comprising N-claps, where M and N are each integers greater than two. Understandably, if the desired activation sounds are sounds rather than the described sequence of hand clap-pairs, some or all of relationships (a), (b), (c), and (d) will no doubt require modification, as will some or all of the preliminary "go/no-go" threshold levels. For example, it is possible that the present invention could be modified to recognize desired activation sounds comprising a sequence of whistles, or finger snaps, or shouts, or a song rhythm, among other sounds.

Referring again to FIG. 2, unit 250 includes a so-called super bright LED that is activated by a push button switch SW1 and powered by battery 260. This LED enables unit 200 to also be used as a flashlight, a rather useful function when trying to open a locked door at night using a key attached to unit 200.

In a preferred embodiment, depressing switch SW1 provides positive battery pulses that preferably are coupled to an input port on microprocessor 240. These pulses advantageously cause unit 200 to enter a "sleep mode" for predetermined increments of time. Upon exiting the sleep mode, unit 200 will beep audibly, which permits unit 200 to be used as an interval timer for the duration of the sleep mode. Pressing SW1 during the sleep mode will reactivate unit 200, such that it is ready to signal process incoming audio sounds within five seconds.

In such embodiment, pressing SW1 twice rapidly (e.g., less than 500 ms from the preceding switch press), causes unit 200 to sleep for 15 minutes. Pressing SW1 three times rapidly puts unit 200 to sleep for 30 minutes, pressing SW1 four times rapidly puts unit 200 to sleep for 45 minutes, and pressing SW1 five times rapidly puts the unit to sleep for 60 minutes. In the preferred embodiment, a user may put the unit to sleep for a maximum of 120 minutes by rapidly pressing SW1 nine times.

Microprocessor 230 causes unit 200 to acknowledge start of sleep mode by having transducer 210 output one short audible beep for each desired 15 minute increment of sleep mode. Upon expiration of the thus-programmed sleep time, unit 200 beeps, thus enabling the unit to function as a timer. For example, upon parking a car at a one-hour parking meter, a user might press SW1 five times rapidly to program a 60 minute time interval. (In immediate response, the unit will beep four times to confirm the programming.) Upon expiration of the 60 minute period, the unit will beep, thus reminding the user to attend to the parking meter to avoid incurring a parking ticket.

Of course other embodiments could provide unit 200 with an incremental timing function that is implemented to provide different time options, including different mechanisms for inputting desired time intervals. However, the preferred embodiment provides this additional function at relatively little additional cost.

FIG. 5A depicts a preferred embodiment of the present invention, which includes the above noted flashlight and interval timer functions in addition to normal detector unit functions. In FIG. 5A, unit 200 is fabricated within a housing 400, whose interior may be acoustically tuned to enhance sound emanating from transducer 210 through grill-like openings in the housing. In this embodiment, the LED preferably points in the forward direction, and switch SW1 is positioned as to be readily available for use. A ring or the like 20 serves to attach small objects 30 to unit 200.

In the embodiment of FIG. 5B, the ring 20 is replaced, or supplemented, with a spring loaded clip fastener 410 that is attachable to housing 400. Clip 410 enables unit 200 to be attached to objects 30 that might be misplaced, especially in time of stress. Such objects might include airline tickets and passports, which are often subject to being misplaced when packing for travel. Of course objects 30 might also include mail, bills, documents, and the like.

FIG. 5C shows a pet collar 420 equipped with a detector unit 200, according to the present invention, for locating a pet that is perhaps hiding or sleeping, a kitten for example.

Figure 5E:
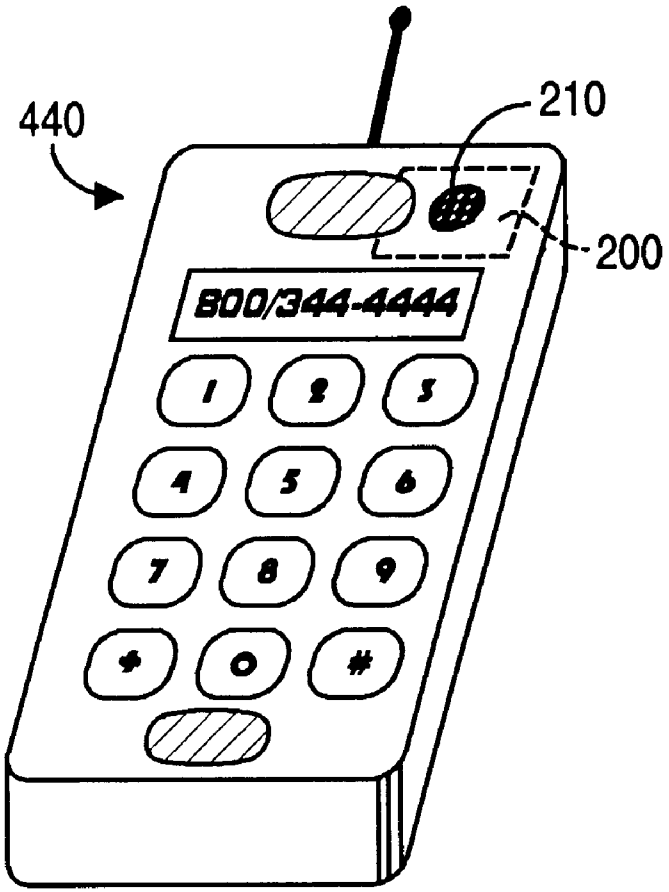
FIG. 5E depicts the present invention built into a communications device such as a wireless telephone.
Figure 5D:
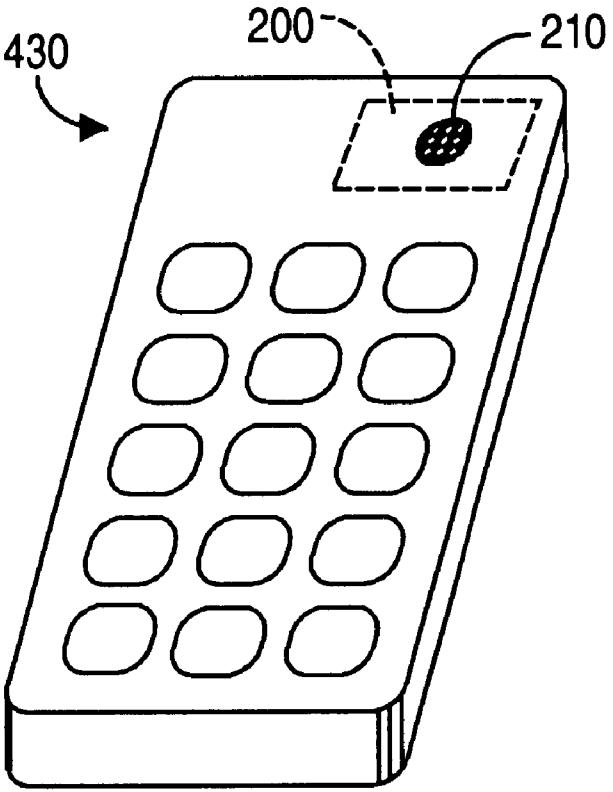
FIG. 5D depicts the present invention built into an electronic device such as a remote control unit.

Although FIGS. 5A, 5B, 5C depicts the present invention as being removably attachable to objects, it will be appreciated that the present invention could instead be permanently built into objects. For example, FIG. 5D depicts a remote control unit 430 for a TV, a VCR, etc. as containing a built-in detector unit or detector module 200, according to the present invention. FIG. 5E shows a detector module 200 built into a wireless telephone 440, or the like.

Figure 6:
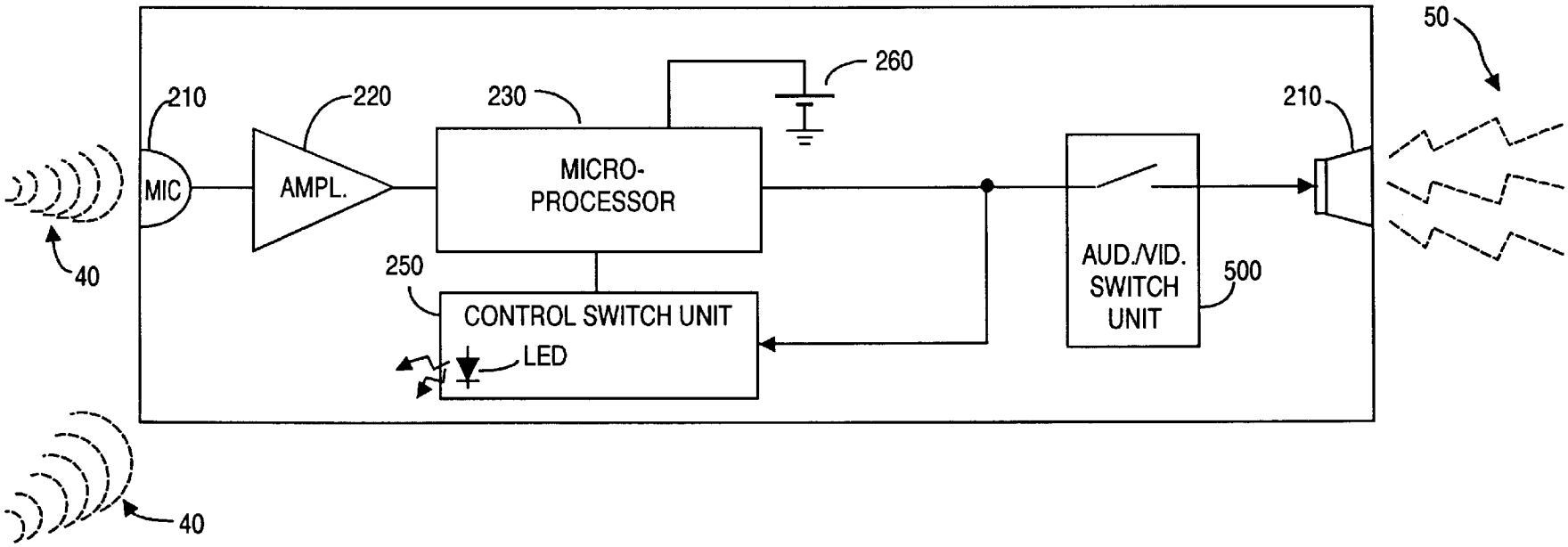
FIG. 6 depicts an embodiment of the present invention in which the locating signal may be visual and/or audible.

It will be appreciated that in some instances an audible locating signal may be less effective than a visual locating signal, or would at least be augmented in effectiveness with a visual locating signal. In the embodiment of FIG. 6, the LED within control switch unit 250 is coupled to an output of microprocessor 230. When microprocessor 230 recognizes a desired sequence of activation sounds, an output signal from microprocessor 230 causes the LED to activate, preferably in a blinking pattern. If desired, the same microprocessor output signal that is, in the above-described embodiments, coupled to transducer 210 is also coupled to the LED. Alternatively, an audio/visual locator switch unit 500 may be provided to allow a user to select whether the locating signal shall be audio and/or visual. If desired, switch unit 500 may include a light or photo sensor device such that in ambient daylight, the LED is not normally activated, but in ambient darkness (where the LED would be seen), the LED is activated. Of course for hearing impaired users, switch unit 500 preferably would always cause the locating signal to be visual with an option for an augmenting audible locating signal as well.

Figure 7:
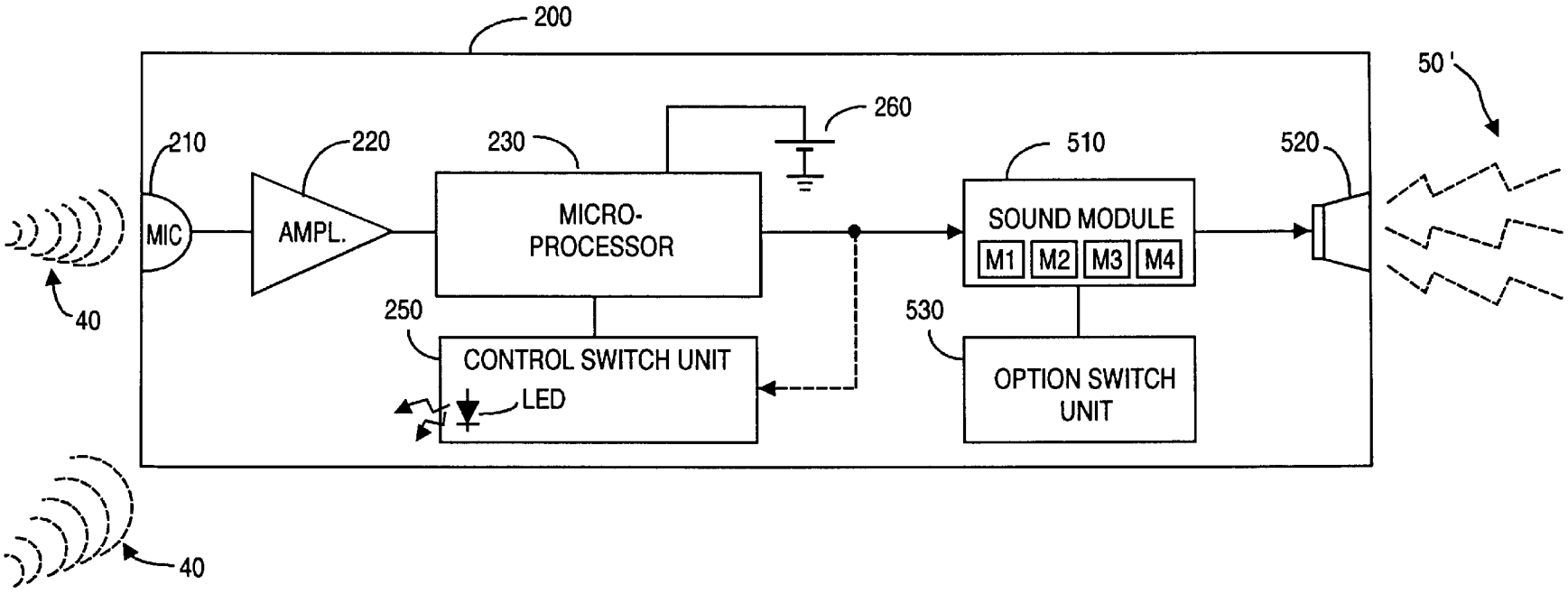
FIG. 7 depicts an embodiment of the present invention in which a sound module provides at least one vocal locating signal.

In the various embodiments hitherto described, the audible locating signal has been a series of beep-like tones. However in everyday life, users may have more experience in detecting the source of more commonly encountered sounds, e.g., human speech, singing, music. In the embodiment of FIG. 7, a sound module 510 is provided, and the output transducer 520 is a unit capable of reproducing sounds throughout a commonly encountered audible spectrum, e.g., from perhaps 40 Hz to about 20 KHz. Collectively, the LED associated with unit 250, and the sound module 510 and transducer 520 define a locator signal generator, whose output locating signal is visual and/or audible.

Sound module 510 preferably is a voice recording unit, for example a commercially available ISB voice recording and playback integrated circuit ("IC"). Such ICs can digitally store ten seconds or more of synthesized sound, including human speech in one or more languages, singing, music, etc. Various pre-stored synthesized sounds are denoted M1, M2, M3, M4 in FIG. 7, it being understood that the total number of such pre-stored sounds may be less than or greater than four. Unit 520 may be a Norris hypersonic acoustical hetrodyne unit marketed by American Technology Corp. of Poway, Calif., although other units may be used instead.

In response to microprocessor unit 230 recognizing a desired activation sound, module 510 causes output transducer 520 to enunciate a locating signal that is a realistic acoustic pattern of sound. For example, unit 510 may cause transducer 520 to output as sound 50' a synthesized pre-stored message M1 that is the spoken words "I am here" or perhaps "Ich bin hier" or "Yo estoy aquí". Because the amount of digital memory required to store a short vocalized phrase is relatively small, unit 510 may store locating signals in several languages (that may be user-selected using option switch unit 530, for example) and/or may store several different messages (also optionally user-selectable using unit 530. A female user of device 200 may, for example, wish to have transducer 520 enunciate a female voice (rather than a male voice) as a locating signal. Another user may wish to have one of several pre-stored songs and/or tunes retained in unit 510 enunciated by transducer 520 as the locating signal.

Figure 8:
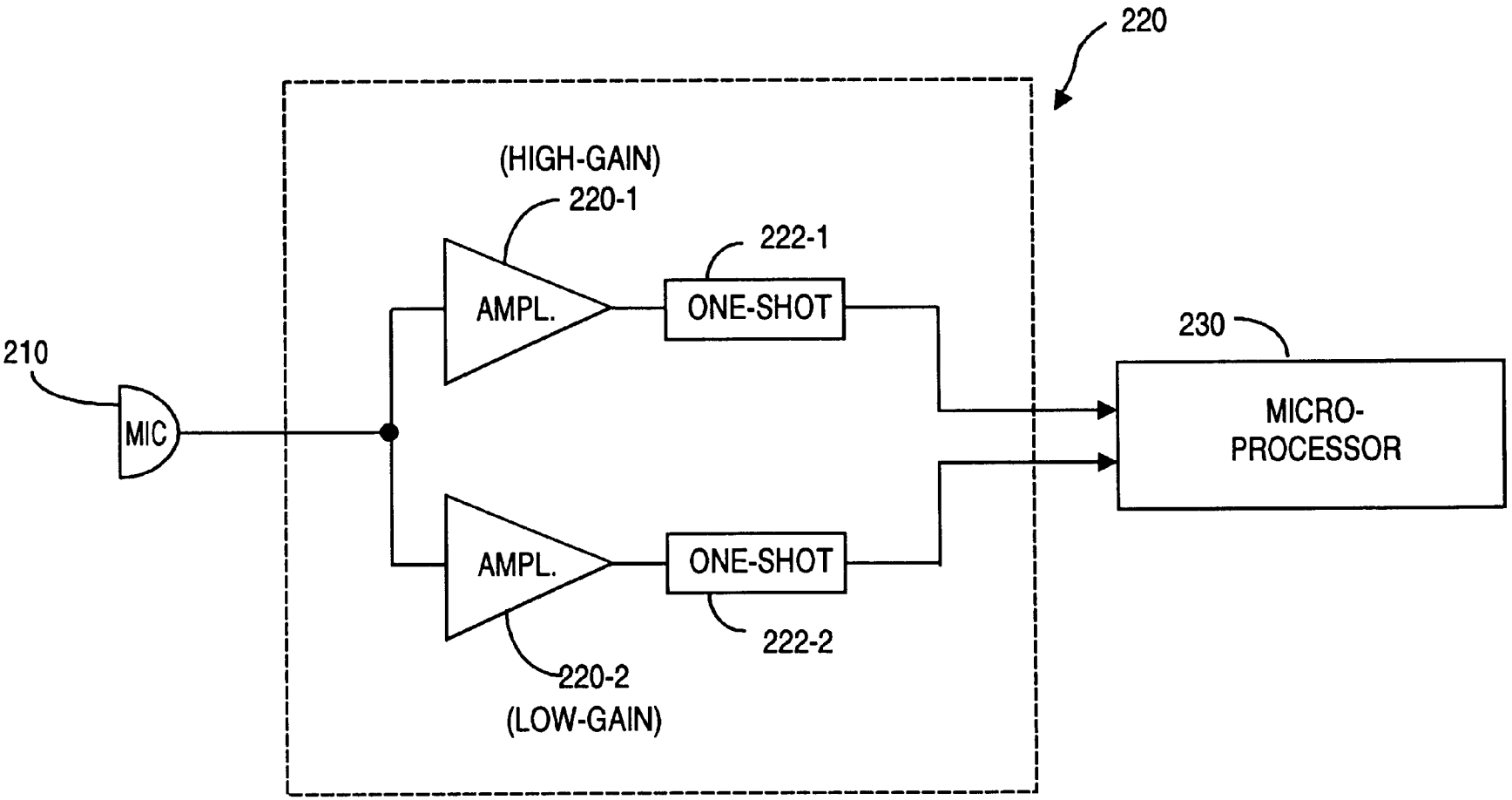
FIG. 8 depicts an adaptively selectable gain amplifier unit used prior to actual signal processing to normalize the effects of ambient noise.

As shown by the embodiment of FIG. 5C, a household pet may be equipped with the present invention 200. It will be appreciated that a mute user may command a trained pet, a dog for example, using a sequence of hand claps. Unit 200 upon recognizing the correct activation sequence can cause sound module 510 to enunciate in a commanding voice "Sit"

or "Come" or "Down", among other animal commands. Indeed, if microprocessor 230 is programmed to recognize more than one pattern of activation sounds, and to cause sound module 510 to output a different locating signal in response to each, one sequence of hand claps may cause unit 200 to command a pet wearing the unit to "Come", and a different sequence of hand claps may cause unit 200 to command the pet to "Sit", among other uses, FIG. 8 depicts a preferred implementation of amplifier unit 220, which implementation may be included with any or all of the embodiments described earlier herein. In practice, the intensity of clapping sounds varies, not only from person to person, but among multiple claps from a single person. Further, the intensity of background noise can vary widely depending upon the environment in which the present invention is being used. Some locations are relatively quiet such that signals from claps are readily identifiable, whereas some environments are quite noisy, making it more difficult for a locator device to process clap-type signals.

Thus, as shown in FIG. 8, preferably audio amplifier unit 220 includes an adaptive gain selection function, whereby amplifier gain is set as a function of environmental background noise.

In the embodiment shown in FIG. 8, unit 220 includes a high gain amplifier 220-1 and a low gain amplifier 220-2, each of which receive the same signal from transducer 210. The gain ratios between these two amplifiers is typically in the range of 10 db to 20 db. The output from each amplifier 220-1, 220-2 is coupled to a monostable one-shot, 222-1, 222-2 respectively, or the equivalent, each one-shot having a preferably fixed output pulse width in the range of perhaps 50 ms to 100 ms.

Even in the absence of hand clap sounds, transducer 210 may detect ambient noise, perhaps human voices in a room. If these voices are sufficiently high in magnitude (or sufficiently close to device 200, the output from amplifier unit 200, which is to say the outputs from amplifiers 220-1, 220-2 may be bursts or sequences of narrow noise pulses, having varying amplitudes and pulse widths of perhaps 1 ms or so. In the preferred embodiment, an adaptive gain selection function is implemented to lower the gain of unit 220 when device 200 is in the presence of high magnitude ambient noise, but to maintain a higher unit 220 gain otherwise.

In the embodiment of FIG. 8, high gain amplifier 220-1 is used by default, unless microprocessor 230 determines that ambient noise signals are too large in magnitude. If too large, then microprocessor 230 will use the output from lower gain amplifier 220-2 until ambient noise signals decrease in magnitude, at which time device 200 will again default to higher gain amplifier 220-1. In the preferred embodiment, the software algorithm executed by microprocessor 240 counts the number of noise generated one-shot pulses from the high gain channel and the low gain channel for a time period of some 5 seconds. If within that time period the high gain channel outputs more than 5 one-shot pulses, then the software determines that ambient noise magnitude is high, and the lower gain channel (e.g., amplifier 200-2) will be used.

Of course adaptive gain selection could be implemented using more amplifier stages, e.g., a high gain, a nearly-high gain, a medium-gain, near-medium gain, low-gain, etc. Further, other pulse widths, and relative frequencies of noise-generated pulses could be used as well. Alternatively, a single amplifier could be used with software-controlled feedback to set the gain as a function of noise-generated signals. For example, the feedback might include a plurality of MOS-switched resistors, with gain modified as a function of the number of resistors present in the circuit, as determined by MOS gate drive signals output by the microprocessor. In any event, applicants have found that the inclusion of adaptive gain selection, prior to actual processing and discrimination of clap-signals, improves device reliability, especially in the presence of high magnitude ambient noise. The inclusion of such an automatic gain control function tends to somewhat normalize signal-to-noise ratios, which improves downstream clap signal detection discrimination.

In the various described embodiments, a user within audible or visual range (perhaps 7 m or more) can locate the misplaced object, be it keys, eyeglasses, mail, remote control unit, cordless telephone, or recalcitrant pet using a sequence of hand claps.

Modifications and variations may be made to the disclosed embodiments without departing from the subject and spirit of the invention as defined by the following claims.

What is claimed is:

1. A method of recognizing desired actuation sounds used by a lost article detector unit in deciding whether to activate a locating signal, the method comprising the following steps:

(i) for a sequence of four actuation sounds definable in terms of an initial pause length P0, a time-length C1 for a first sound in said sequence, a pause length P1 between said first sound and a second sound in said sequence, a time-length C2 for said second sound, a pause length P2 between said second sound and a third sound in said sequence, a time-length C3 for said third sound in said sequence, a pause length P3 between said third sound and a fourth sound in said sequence, a time-length C4 for said fourth sound, and a final pause length P4 following said fourth sound, calculating and storing data for at least said C1, P1, C2, C3, P3, and C4;

(ii) using data selected from said C1, P1, and C2 to discriminate, using at least one predetermined relationship, against data selected from said C3, P3, and C4, to determine whether said sequence represents said desired actuation sounds; and (iii) if step (ii) is satisfied, causing said detector unit to activate said locating signal, wherein said locating signal includes at least one signal selected from the group consisting of (a) a visual signal, (b) a pre-stored synthesized vocal message, and (c) a prestored synthesized musical passage.

2. The method of claim 1, wherein step (ii) includes satisfying, in any order, at least two relationships selected from the group consisting of:

(a) $|C3-C1|/C1<Ta$;

(b) $|P3-P1|/P1<Tb$;

(c) $|C4-C2|/C2<Tc$; and (d) $|R2-R1|/R1<Td$;

where R1=C1+P1, R2=C3+P3, and where Ta, Tb, Tc, Td are tolerance constants each less than about 0.50.

3. The method of claim 1, wherein step (ii) includes satisfying, in any order, each of relationships (a), (b), (c), and (d) as follows:

(a) $|C3-C1|/C1<Ta$;

(b) $|P3-P1|/P1<Tb$;

(c) $|C4-C2|/C2<Tc$; and (d) $|R2-R1|/R1<Td$;

where R1=C1+P1, R2=C3+P3, and where Ta, Tb, Tc, Td are tolerance constants each less than about 0.50.

4. The method of claim 1, wherein step (ii) further includes, in any order, at least two preliminary steps selected from the group consisting of (ii-1) ensuring that P0≧1,000 ms wherein step (i) further includes calculating and storing data for P0, (ii-2) ensuring that 50 ms≦C1≦125 ms, (ii-3) ensuring that 50 ms≦C2≦125 ms, (ii-4) ensuring that 125 ms≦P1≦250 ms, (ii-5) ensuring that 500 ms≦P2≦2,000 ms wherein step (i) further includes calculating and storing data for P2, (ii-6) ensuring that P4≧500 ms wherein step (i) further includes calculating and storing data for P4, (ii-7) ensuring that P2>P1 wherein step (i) further includes calculating and storing data for P2, and (ii-8) ensuring that P2>P3 wherein step (i) further includes calculating and storing data for P2;

wherein if said included preliminary steps are not satisfied, said method reverts to step (i) using a next sequence of sounds.

5. The method of claim 4, wherein step (ii) includes, in any order, at least six said preliminary steps.

6. The method of claim 1, wherein said desired actuation sounds comprise a first pair of hand claps definable as said data C1, P1, C2, and a second pair of hand claps definable as said data C3, P3, C4, wherein said second pair of hand claps is separated by said data P2 from said first pair of hand claps.

7. The method of claim 1, wherein step (iii) is carried out by providing at least one of (a-1) an LED, (b-1) a sound module in which at least one synthesized pattern of human speech is stored, (b-2) a sound module in which at least one enunciable pattern of human speech is stored in at least two different languages, (b-3) a sound module in which at least one enunciable pattern of human speech is stored in chosen one of a male voice and a female voice, (c-1) a sound module in which at least one pre-stored musical tune is stored, and (c-2) a sound module in which at least one musical song is stored.

8. The method of claim 1, further including a step preliminary to step (i) of at least partially normalizing signal-to-noise ratio of magnitude of signals representing said first sound, said second sound, said third sound, and said fourth sound to magnitude of ambient environmental noise sounds.

9. For use with a lost article detector unit, a method of recognizing a desired actuating sequence comprising at least an initial pause length P0, a first pair of hand claps having a first clap of time duration C1, a second clap of time duration C2 and an inter-clap period of P1 therebetween, and after a pause P2 a second pair of hand claps having a third clap of time duration C3, a fourth clap of time duration C4, and an inter-clap period of P3 therebetween, and a final pause length P4 following said fourth clap, the method comprising the following steps:

(i) calculating and storing data for at least said C1, P1, C2, C3, P3 and C4;

(ii) using data selected from C1, P1, and C2 to discriminate using at least one predetermined relationship, against data selected from C3, P3, and C4, to determine whether said sequence represents said desired actuation sequence; and (iii) if step (ii) is satisfied, causing said detector unit to activate a locating signal, wherein said locating signal includes at least one signal selected from the group consisting of (a) a visual signal, (b) a pre-stored synthesized speech message, and (c) a prestored synthesized music passage.

10. The method of claim 9, wherein step (ii) includes satisfying, in any order, at least two relationships selected from the group consisting of:

(a) $|C3-C1|/C1<Ta$;

(b) $|P3-P1|/P1<Tb$;

(c) $|C4-C2|/C2<Tc$; and (d) $|R2-R1|/R1<Td$;

where R1=C1+P1, R2=C3+P3, and where Ta, Tb, Tc, Td are tolerance constants and are each less than about 0.50.

11. The method of claim 9, wherein step (ii) includes satisfying, in any order, each of relationships (a), (b), (c), and (d) as follows:

(a) $|C3-C1|/C1<Ta$;

(b) $|P3-P1|/P1<Tb$;

(c) $|C4-C2|/C2<Tc$; and (d) $|R2-R1|/R1<Td$;

where R1=C1+P1, R2=C3+P3, and Ta, Tb, Tc, Td are tolerance constants and are each less than about 0.50.

12. The method of claim 9, wherein step (ii) further includes, in any order, at least two preliminary steps selected from the group consisting of (ii-1) ensuring that P0≧1,000 ms wherein step (i) further includes calculating and storing data for P0, (ii-2) ensuring that 50 ms≦C1≦125 ms, (ii-3) ensuring that 50 ms≦C2≦125 ms, (ii-4), ensuring that 125 ms≦P1≦250 ms, (ii5) ensuring that 500 ms≦P2≦2,000 ms, (ii-6) ensuring that P4≧500 ms wherein step (i) further includes calculating and storing data for P4, (ii-7) ensuring that P2>P1 wherein step (i) further includes calculating and storing data for P2, and (ii-8) ensuring that P2>P3 wherein step (i) further includes calculating and storing data for P2;

wherein if included said preliminary steps are not satisfied, said method reverts to step (i) using a next sequence of sounds.

13. The method of claim 12, wherein step (ii) includes, in any order, at least six said preliminary steps.

14. The method of claim 9, wherein step (iii) is carried out by providing at least one of (a-1) an LED, (b-1) a sound module in which at least one synthesized pattern of human speech is stored, (b-2) a sound module in which at least one enunciable pattern of human speech is stored in at least two different languages, (b-3) a sound module in which at least one enunciable pattern of human speech is stored in chosen one of a male voice and a female voice, (c-1) a sound module in which at least one pre-stored musical tune is stored, and (c-2) a sound module in which at least one musical song is stored.

15. The method of claim 9, further including a step preliminary to step (i) of at least partially normalizing signal-to-noise ratio of magnitude of signals representing said first clap, said second clap, said third clap, and said fourth clap to magnitude of ambient environmental noise sounds.

16. For use with a lost article detector unit, a method of recognizing a desired actuating sequence comprising at least an initial pause length P0, a first pair of hand claps having a first clap of time duration C1, a second clap of time duration C2 and an inter-clap period of P1 therebetween, and after a pause P2 a second pair of hand claps having a third clap of time duration C3, a fourth clap of time duration C4, and an inter-clap period of P3 therebetween, and a final pause length P4 following said fourth clap, the method comprising the following steps:

(i) at least partially normalizing signal-to-noise ratio of magnitude of signals representing said first clap, said second clap, said third clap, and said fourth clap to magnitude of ambient environmental noise sounds;

(ii) calculating and storing data for at least said C1, P1, C2, C3, P3 and C4;

(iii) using data selected from C1, P1, and C2 to discriminate using at least one predetermined relationship, against data selected from C3, P3, and C4, to determine whether said sequence represents said desired actuation sequence; and (iv) if step (iii) is satisfied, causing said detector unit to activate a locating signal, wherein said locating signal includes at least one signal selected from the group consisting of (a) a visual signal, (b) an audible signal, (c) a pre-stored synthesized speech message, and (d) a pre-stored synthesized music passage.

17. The method of claim 16, wherein step (iii) includes satisfying, in any order, at least two relationships selected from the group consisting of:

(a) $|C3-C1|/C1<Ta$;

(b) $|P3-P1|/P1<Tb$;

(c) $|C4-C2|/C2<Tc$; and (d) $|R2-R1|/R1<Td$;

where R1=C1+P1, R2=C3+P3, and where Ta, Tb, Tc, Td are tolerance constants and are each less than about 0.50.

18. The method of claim 16, wherein step (iii) includes satisfying, in any order, each of relationships (a), (b), (c), and (d) as follows:

(a) $|C3-C1|/C1<Ta$;

(b) $|P3-P1|/P1<Tb$;

(c) $|C4-C2|/C2<Tc$; and (d) $|R2-R1|/R1<Td$;

where R1=C1+P1, R2=C3+P3, and Ta, Tb, Tc, Td are tolerance constants and are each less than about 0.50.

19. The method of claim 16, wherein step (iii) further includes, in any order, at least two preliminary steps selected from the group consisting of (iii-1) ensuring that $P0 \geqq 1{,}000$ ms wherein step (ii) further includes calculating and storing data for P0, (iii-2) ensuring that 50 ms$\leqq C1 \leqq$125 ms, (iii-3) ensuring that 50 ms$\leqq C2 \leqq$125 ms, (iii-4), ensuring that 125 ms$\leqq P1 \leqq$250 ms, (iii-5) ensuring that 500 ms$\leqq P2 \leqq$2,000 ms, (iii-6) ensuring that $P4 \geqq 500$ ms wherein step (ii) further includes calculating and storing data for P4, (iii-7) ensuring that P2>P1 wherein step (ii) further includes calculating and storing data for P2, and (iii-8) ensuring that P2>P3 wherein step (ii) further includes calculating and storing data for P2;

wherein if included said preliminary steps are not satisfied, said method reverts to step (ii) using a next sequence of sounds.

20. The method of claim 19, wherein step (iii) includes, in any order, at least six said preliminary steps.

21. The method of claim 16, wherein step (iv) is carried out by providing at least one of (a-1) an LED, (b-1) a transducer able to emit a beeping sound, (b-2) a sound module in which at least one synthesized pattern of human speech is stored, (b-3) a sound module in which at least one enunciable pattern of human speech is stored in at least two different languages, (b-4) a sound module in which at least one enunciable pattern of human speech is stored in chosen one of a male voice and a female voice, (c-1) a sound module in which at least one pre-stored musical tune is stored, and (c-2) a sound module in which at least one musical song is stored.

22. A lost article detector module, comprising:

an input transducer that generates an internal signal in response to audible sound;

a locator signal generator that generates a locator signal in response to detection by said detector module of a desired actuating sequence of said audible sound, said locator signal generator including at least one of a visual indicator and a sound module unit;

a microprocessor unit having an input port coupled to receive said internal signal from said input transducer, and having an output port coupled to an input port of said locator signal generator;

said microprocessor unit including at least a clock system, a counter system, an arithmetic-logic system, a persistent read only memory (ROM) system, and a volatile random access memory (RAM) system;

said microprocessor unit programmed to execute a routine stored in said ROM to analyze a sequence of sounds and to recognize a desired actuating sequence comprising at least an initial pause length P0, a first pair of sounds having a first sound of time duration C1, a second sound of time duration C2 and an inter-sound period of P1 therebetween, and after a pause P2 a second pair of sounds having a third sound of time duration C3, a fourth sound of time duration C4, an inter-sound period of P3 therebetween, and a final pause length P4 following said fourth sound;

said microprocessor unit using said clock system and said counter system to calculate and to store data in said RAM representing at least said C1, P1, C2, C3, P3, and C4;

said microprocessor unit using data selected from said C1, P1, and C2 to discriminate, using at least one predetermined relationship, against data selected from said C3, P3, and C4 to determine whether said sequence represents said desired actuating sequence; and if said sequence represents said desired actuating sequence, said microprocessor unit causing said locator signal generator to activate a locating signal.

23. The detector module of claim 22, wherein in determining whether said sequence represents said desired actuating sequence, said microprocessor unit requires satisfaction, in any order, of at least two relationships selected from the group consisting of:

(a) $|C3-C1|/C1<Ta$;

(b) $|P3-P1|/P1<Tb$;

(c) $|C4-C2|/C2<Tc$; and (d) $|R2-R1|/R1<Td$;

wherein R1=C1+P1, R2=C3+P3, and Ta, Tb, Tc, Td are tolerance constants storable in said ROM;

wherein unless a sufficient number of said relationships is satisfied, said counter system and said RAM are reset.

24. The detector module of claim 22, wherein in determining whether said sequence represents said desired actuating sequence, said microprocessor unit requires satisfaction, in any order, of each relationship as follows:

(a) $|C3-C1|/C1<Ta$;

(b) $|P3-P1|/P1<Tb$;

(c) $|C4-C2|/C2<Tc$; and (d) $|R2-R1|/R1<Td$;

wherein R1=C1+P1, R2=C3+P3, and Ta, Tb, Tc, Td are preselected tolerance constants;

wherein unless each said relationship is satisfied, said counter system and said RAM are reset.

25. The detector module of claim 24, wherein each of said preselected tolerance constants is less than about 0.50.

26. The detector module of claim 22, wherein each said sound is a hand clap.

27. The detector module of claim 26, wherein said microprocessor unit determines, in any order, at least two preliminary relationships selected from the group consisting of (a) ensuring that $P0 \geqq 1{,}000$ ms wherein said microprocessor unit further calculates and stores P0, (b) ensuring that 50 ms$\leqq C1 \leqq$125 ms, (c) ensuring that 50 ms$\leqq C2 \leqq$125 ms , (d) ensuring that 125 ms$\leqq P1 \leqq$250 ms, (e) ensuring that 500 ms$\leqq P2 \leqq$2,000 ms wherein said microprocessor unit further calculates and stores P2, and (f) ensuring that $P4 \geqq 500$ ms wherein said microprocessor unit further calculates and stores P4, (g) ensuring that P2>P1 wherein said microprocessor unit further calculates and stores P2, and (h) ensuring that P2>P3 wherein said microprocessor unit further calculates and stores P2.

28. The detector module of claim 22, further including an illuminating device switchably coupled to a power supply of said detector module enabling said detector module to provide a flashlight function.

29. The detector module of claim 22, further including a pulse unit switchably coupled to an input port of said microprocessor unit forcing said microprocessor unit into a sleep mode for a desired time period determined at least in part by a number of user-generated pulses from said pulse unit;

wherein upon expiration of said desired time period said microprocessor unit causes said transducer to beep audibly.

30. The detector module of claim 29, wherein said microprocessor unit causes said transducer to beep audibly a number of times proportional to said desired time period;

wherein audible confirmation of programming said desired time period into said detector module is provided.

31. The detector module of claim 22, wherein said detector module is housed within a housing selected from the group consisting of (a) a stand-alone housing for said detector module, (b) a housing that also houses a remote control device, (c) a housing that also houses a wireless communications device, (d) a housing that includes a ring adapted to retain a lost article including a key, (e) a housing including a fastener adapted to retain a lost article including a document, and (f) a housing adapted to be attached to a living animal.

32. A lost article detector module, comprising:

an input transducer that generates an internal signal in response to audible sound;

an amplifier unit, coupled to receive and to amplify said internal signal by a gain that is at least in part proportional to magnitude of ambient noise detected by said input transducer;

a locator signal generator that generates a locator signal in response to detection by said detector module of a desired actuating sequence of said audible sound, said locator signal generator including at least one of a visual indicator, a sound beep-generating transducer, and a sound module unit;

a microprocessor unit having an input port coupled to receive the amplified signal from said input transducer, and having an output port coupled to an input port of said locator signal generator;

said microprocessor unit including at least a clock system, a counter system, an arithmetic-logic system, a persistent read only memory (ROM) system, and a volatile random access memory (RAM) system;

said microprocessor unit programmed to execute a routine stored in said ROM to analyze a sequence of sounds and to recognize a desired actuating sequence comprising at least an initial pause length P0, a first pair of sounds having a first sound of time duration C1, a second sound of time duration C2 and an inter-sound period of P1 therebetween, and after a pause P2 a second pair of sounds having a third sound of time duration C3, a fourth sound of time duration C4, an inter-sound period of P3 therebetween, and a final pause length P4 following said fourth sound;

said microprocessor unit using said clock system and said counter system to calculate and to store data in said RAM representing at least said C1, P1, C2, C3, P3, and C4;

said microprocessor unit using data selected from said C1, P1, and C2 to discriminate, using at least one predetermined relationship, against data selected from said C3, P3, and C4 to determine whether said sequence represents said desired actuating sequence; and if said sequence represents said desired actuating sequence, said microprocessor unit causing said locator signal generator to activate a locating signal.

33. The detector module of claim 32, wherein in determining whether said sequence represents said desired actuating sequence, said microprocessor unit requires satisfaction, in any order, of at least two relationships selected from the group consisting of:

(a) $|C3-C1|/C1<Ta$;

(b) $|P3-P1|/P1<Tb$;

(c) $|C4-C2|/C2<Tc$; and (d) $|R2-R1|/R1<Td$;

wherein R1=C1+P1, R2=C3+P3, and Ta, Tb, Tc, Td are tolerance constants storable in said ROM;

wherein unless a sufficient number of said relationships is satisfied, said counter system and said RAM are reset.

34. The detector module of claim 32, wherein in determining whether said sequence represents said desired actuating sequence, said microprocessor unit requires satisfaction, in any order, of each relationship as follows:

(a) $|C3-C1|/C1<Ta$;

(b) $|P3-P1|/P1<Tb$;

(c) $|C4-C2|/C2<Tc$; and (d) $|R2-R1|/R1<Td$;

wherein R1=C1+P1, R2=C3+P3, and Ta, Tb, Tc, Td are preselected tolerance constants;

wherein unless each said relationship is satisfied, said counter system and said RAM are reset.

35. The detector module of claim 34, wherein each of said preselected tolerance constants is less than about 0.50.

36. The detector module of claim 32, wherein each said sound is a hand clap.

37. The detector module of claim 36, wherein said microprocessor unit determines, in any order, at least two preliminary relationships selected from the group consisting of (a) ensuring that $P0 \geqq 1{,}000$ ms wherein said microprocessor unit further calculates and stores P0, (b) ensuring that $50 \text{ ms} \leqq C1 \leqq 125$ ms, (c) ensuring that $50 \text{ ms} \leqq C2 \leqq 125$ ms , (d) ensuring that $125 \text{ ms} \leqq P1 \leqq 250$ ms, (e) ensuring that $500 \text{ ms} \leqq P2 \leqq 2{,}000$ ms wherein said microprocessor unit further calculates and stores P2, and (f) ensuring that $P4 \geqq 500$ ms wherein said microprocessor unit further calculates and stores P4, (g) ensuring that P2>P1 wherein said microprocessor unit further calculates and stores P2, and (h) ensuring that P2>P3 wherein said microprocessor unit further calculates and stores P2.

38. The detector module of claim 32, wherein said detector module is housed within a housing selected from the group consisting of (a) a stand-alone housing for said detector module, (b) a housing that also houses a remote control device, (c) a housing that also houses a wireless communications device, (d) a housing that includes a ring adapted to retain a lost article including a key, (e) a housing including a fastener adapted to retain a lost article including a document, and (f) a housing adapted to be attached to a living animal.

* * * * *